US007869923B2

(12) United States Patent
Kawaguchi

(10) Patent No.: US 7,869,923 B2
(45) Date of Patent: Jan. 11, 2011

(54) SLEWING CONTROLLER, SLEWING CONTROL METHOD, AND CONSTRUCTION MACHINE

(75) Inventor: Tadashi Kawaguchi, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 937 days.

(21) Appl. No.: 11/575,747

(22) PCT Filed: Sep. 22, 2005

(86) PCT No.: PCT/JP2005/017500

§ 371 (c)(1),
(2), (4) Date: Mar. 21, 2007

(87) PCT Pub. No.: WO2006/033399

PCT Pub. Date: Mar. 30, 2006

(65) Prior Publication Data

US 2008/0065298 A1 Mar. 13, 2008

(30) Foreign Application Priority Data

Sep. 24, 2004 (JP) ..... 2004-277711

(51) Int. Cl.
*G06F 19/00* (2006.01)

(52) U.S. Cl. ..... 701/50; 701/1; 37/340; 37/341; 37/348; 37/382; 37/414; 180/326; 182/62.5; 182/69.4; 318/371; 318/372; 318/461; 700/245

(58) Field of Classification Search ..... None
See application file for complete search history.

(56) References Cited

U.S. PATENT DOCUMENTS 3,669,286 A * 6/1972 Gauchet ..... 414/694

(Continued)

FOREIGN PATENT DOCUMENTS

JP 2583668 A 11/1996

(Continued)

OTHER PUBLICATIONS

PCT International Preliminary Report on Patentability and Written Opinion, Chapter I of the Patent Cooperation Treaty, dated Mar. 27, 2007, for PCT/JP2005/017500. 4 sheets.

(Continued)

*Primary Examiner*—Khoi Tran
*Assistant Examiner*—Jonathan L Sample
(74) *Attorney, Agent, or Firm*—Holtz, Holtz, Goodman & Chick, PC

(57) ABSTRACT

In an excavator equipped with an offset boom, an offset command value generating device of a rotation control device offsets a second boom arranged on a distal end side in a rotation direction relative to a first boom arranged on a proximal end side when an acceleration start judging device judges that a rotation operation is started, and offsets the second boom in a reverse rotation direction when a deceleration start judging device judges that a rotation deceleration operation is started. Accordingly, when a rotation acceleration is performed using a reaction force generated in the offset, clearances between members of a work machine can be contracted in advance in the rotation direction, while when the rotation deceleration operation is performed, these clearances can be contracted in advance in the rotation reverse direction, thereby reducing an impact in the acceleration and deceleration.

16 Claims, 12 Drawing Sheets

U.S. PATENT DOCUMENTS

| | | | | |
|---|---|---|---|---|
| 4,866,641 | A * | 9/1989 | Nielsen et al. | 700/302 |
| 6,052,636 | A * | 4/2000 | Lombardi | 701/50 |
| 6,076,029 | A * | 6/2000 | Watanabe et al. | 701/50 |
| 6,171,030 | B1 * | 1/2001 | Miyake et al. | 405/258.1 |
| 6,352,133 | B1 * | 3/2002 | Ojima | 180/326 |
| 6,378,653 | B1 * | 4/2002 | Takahashi | 182/69.4 |
| 6,496,766 | B1 * | 12/2002 | Bernold et al. | 701/50 |
| 7,067,999 | B2 * | 6/2006 | Sugano et al. | 318/372 |
| 7,500,532 | B2 * | 3/2009 | Koga et al. | 180/89.13 |
| 7,532,967 | B2 * | 5/2009 | Fujishima et al. | 701/50 |
| 2004/0111229 | A1 * | 6/2004 | Colburn | 702/94 |
| 2004/0117095 | A1 * | 6/2004 | Colburn et al. | 701/50 |
| 2004/0158381 | A1 * | 8/2004 | Strelioff et al. | 701/50 |
| 2005/0027420 | A1 * | 2/2005 | Fujishima et al. | 701/50 |
| 2005/0253542 | A1 * | 11/2005 | Sugano et al. | 318/371 |
| 2006/0085116 | A1 * | 4/2006 | Suzuki et al. | 701/50 |
| 2007/0005208 | A1 * | 1/2007 | Han et al. | 701/50 |

FOREIGN PATENT DOCUMENTS

| | | | |
|---|---|---|---|
| JP | 10-30248 | A | 2/1998 |
| JP | 2000-73410 | A | 3/2000 |
| JP | 2000-273913 | A | 10/2000 |
| JP | 2001-11897 | A | 1/2001 |
| JP | 2002-371579 | A | 12/2002 |
| WO | WO 2004/027164 | * | 4/2004 |

OTHER PUBLICATIONS

Japanese Office Action (and English translation thereof) dated Sep. 16, 2008, issued in a corresponding Japanese Application.

* cited by examiner

SLEWING CONTROLLER, SLEWING CONTROL METHOD, AND CONSTRUCTION MACHINE

This application is a U.S. National Phase Application under 35 USC 371 of International Application PCT/JP2005/017500 filed Sep. 9, 2005.

TECHNICAL FIELD

The present invention relates to a rotation control device and a rotation control method for controlling a rotary body equipped with an offset mechanism and a construction machine including the rotation control device.

BACKGROUND ART

There have been conventionally known construction machines such as a hydraulic excavator equipped with an offset boom (see, for instance, Patent Document 1).

The offset boom includes a first boom supported on an upper rotary body and a second boom rotatably coupled to a distal end of the first boom, where the second boom can be offset relative to the first boom by a telescopic motion of an offset cylinder that connects a proximal end of the second boom to a bracket on a distal end side of the second boom.

Recently, hybrid electric rotary excavators have been being developed, in which a rotary body is driven by an electric motor and other members such as a work machine and a carrier are driven by a hydraulic actuator (see, for instance, Patent Document 2).

Since the rotation of the rotary body is driven by the electric motor in such electric rotary excavators, even when the rotary body is rotated while a boom and an arm that are driven hydraulically are lifted up, the rotation of the rotary body is not affected by the lifting of the boom and the arm. Accordingly, an energy loss at control valves or the like can be reduced as compared to an arrangement in which the rotary body is hydraulically driven, thereby enhancing energy efficiency.

[Patent Document 1]
JP-A-2002-371579
[Patent Document 2] JP-A-2001-11897

DISCLOSURE OF THE INVENTION

Problems to be Solved by the Invention

Meanwhile, in excavators, there exist designed clearances at coupling portions between the rotary body and the boom and between the boom and the arm, and there also exists a clearance (backlash) at a meshing portion between a swing circle and a gear on a drive motor side. These clearances are contracted just after the rotary body is rotated, which generates an impact (shock) and impedes operability. In addition, when the rotary body that is rotated at a constant speed is decelerated, the clearances are contracted in an opposite direction, so that the impact is generated similarly. Especially, in excavators equipped with the offset boom which additionally includes a coupling portion between the first boom and the second boom, a clearance is large due to its increased number of coupling portion, so that the impact is also large.

In the electric rotary excavators, the rotary body rotates subtly as compared to an arrangement in which the rotary body is rotated by a hydraulic motor, a magnitude of the impact is even larger, so that there is a demand to solve the problem. However, even in the arrangement in which the rotary body is rotated by the hydraulic motor, although a magnitude of the impact is not so large as compared to the arrangement in which the rotary body is rotated by the electric motor, there is a desire for reduction of the impact and improvement of the operability.

Further, in the excavators equipped with the offset boom, the clearances are even larger, which causes degradation of a positioning accuracy of the bucket in stopping the rotary body. Accordingly, it is necessary to reduce an influence of the clearance to stop the rotary body more smoothly in order to enhance the positioning accuracy of the bucket.

An object of the present invention is to provide, for a rotary body equipped with an offset mechanism such as an offset boom, a rotation control device, a rotation control method and a construction machine that are capable of suppressing an impact in a rotation operation of the rotary body to enhance an operability and stopping the rotary body smoothly to enhance a stop positioning accuracy.

Means for Solving the Problems

A rotation control device according to an aspect of the present invention is the rotation control device that controls a rotary body that is equipped with an offset mechanism including a distal-end side work member, the rotation control device adapted to move the offset mechanism in conjunction with a rotation operation of the rotary body.

According to the aspect of the present invention, since the offset mechanism is moved in conjunction with the rotation operation of the rotary body, a backlash can be contracted in advance due to this motion of the offset mechanism, so that an impact in the rotation operation can be suppressed. In addition, by moving the offset mechanism just before stopping the rotation, the rotary body can be smoothly stopped, thereby enhancing a positioning accuracy of the work members.

In the rotation control device according to the aspect of the present invention, it is preferable that the rotation control device offsets the distal-end side work member in a rotation direction in conjunction with the rotation operation when the rotation operation or an acceleration operation is started.

According to the aspect of the present invention, since the distal-end side work member is offset in the rotation direction when the rotation operation or the rotation acceleration operation is started, a clearance between members is contracted by a reaction force in a direction not generating the impact when the rotation or acceleration is started. Since the rotary body subsequently starts actual rotation or acceleration, the rotation operation can be performed without generation of the impact, thereby enhancing the operability.

In the rotation control device according to the aspect of the present invention, it is preferable that the rotation control device offsets the distal-end side work member in a reverse rotation direction in conjunction with the rotation operation when a rotation deceleration operation is started.

According to the aspect of the present invention, since the distal-end side work member is offset in the reverse rotation direction when the rotation deceleration operation is started, the clearances between the component is contracted a the reaction force in a direction not generating the impact of the deceleration in just before the deceleration of the rotary body. Since the rotary body subsequently starts actual deceleration, the rotary body is decelerated with the clearance being contracted, so that the rotation deceleration can be performed without generation of the impact, thereby enhancing the operability.

In the rotation control device according to the aspect of the present invention, it is preferable that the rotation control device offsets the distal-end side work member in a reverse rotation direction in conjunction with the rotation operation just before the rotation is stopped.

According to the aspect of the present invention, the distal-end side work member is offset in the reverse rotation direction just before the rotary body is stopped. At this time, by stopping the distal-end side work member at a targeted position, the rotary body stops with a slightly flowing motion after the distal-end side work member is stopped, which increases a braking distance, thereby preventing a sudden stop and enabling the rotary body to stop smoothly. With the arrangement, a swinging-back of the rotary body hardly occurs, so that stop positioning accuracies of the work members can be enhanced. In a case with an excavator, a stop positioning accuracy of the bucket can be enhanced.

In the rotation control device according to the aspect of the present invention, it is preferable that an offset change amount is adjustable in accordance with a rotation state of the rotary body.

According to the aspect of the present invention, the offset amount can be adjusted in accordance with the rotation state of the rotary body. Specifically, when the rotary body is stopped from a high-speed rotation state, the offset amount is set to large. With the arrangement, an amount of the flowing motion of the rotary body becomes large to increase the braking distance, so that the rotary body can be stopped smoothly.

However, the amount of the flowing motion of the rotary body is preferably controlled to a certain degree that does not cause an operator to feel a sense of discomfort.

In the rotation control device according to the aspect of the present invention, it is preferable that a generated offset is corrected toward an initial value.

It should be noted that "the initial value" refers to the last value of the time when the operator artificially makes an offset operation.

According to the aspect of the present invention, the generated offset is corrected in the initial value direction. With the arrangement, when the rotary body stops, the distal-end side work member returns to an offset amount of the time before rotation, so that the operator can perform the rotation operation without feeling the sense of discomfort.

According to another aspect of the invention, a rotation control method for controlling a rotary body that is equipped with an offset mechanism including a distal-end side work member includes moving the offset mechanism in conjunction with a rotation operation of the rotary body.

According to the aspect of the present invention, the impact in the rotation operation can be suppressed to enhance the operability, and the rotary body can be stopped smoothly in stopping the rotation, thereby enhancing the stop positioning accuracy of the work members.

A construction machine according to still another aspect of the present invention includes: a rotary body that is equipped with an offset mechanism including a distal-end side work member; and the above-described rotation control device of the present invention, the rotation control device controlling the rotary body.

According to the aspect of the present invention, since the construction machine includes the above-described rotation control device of the present invention, the construction machine having the same advantages can be provided.

In the construction machine according to the aspect of the present invention, it is preferable that the offset mechanism includes a proximal-end side work member supported on the rotary body and a distal-end side work member that is coupled to the proximal-end side work member, the distal-end side work member being offset, and that the rotary body is rotated by an electric motor.

According to the aspect of the present invention, the offset mechanism includes two members, which are the proximal-end side work member and the proximal-end side work member, and a clearance existing between the two members is also contracted when the rotation operation is performed, so that the improvement of the operability is more noticeable. Although the rotary body driven by the electric motor typically moves subtly and causes the operator to feel a larger impact from the clearances, the influence of the clearances due to such a subtle movement can also be reduced, so that the improvement of the operability is more noticeable.

EXPLANATION OF CODES

1, 30: electric rotary excavator (construction machine)
4: rotary body
5: electric motor
6: offset mechanism
20: hydraulic excavator (construction machine)
50: rotation control device
61: first boom (proximal-end side work member)
62: second boom (distal-end side work member)

BEST MODE FOR CARRYING OUT THE INVENTION

[1] Overall Arrangement

Figure 1:
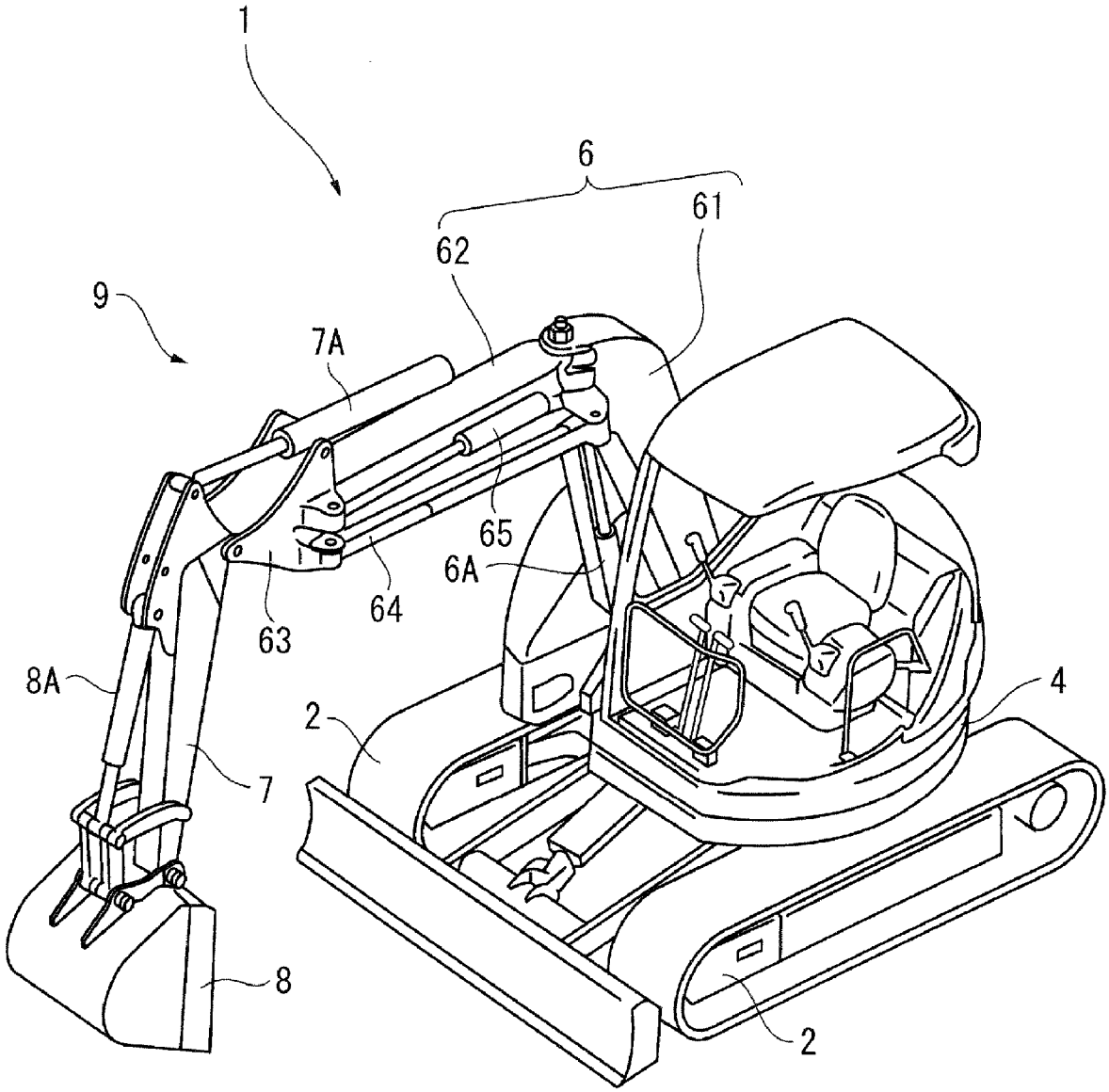
FIG. 1 is a perspective view showing an overall arrangement of a construction machine according to a first embodiment of the present invention.
Figure 2:
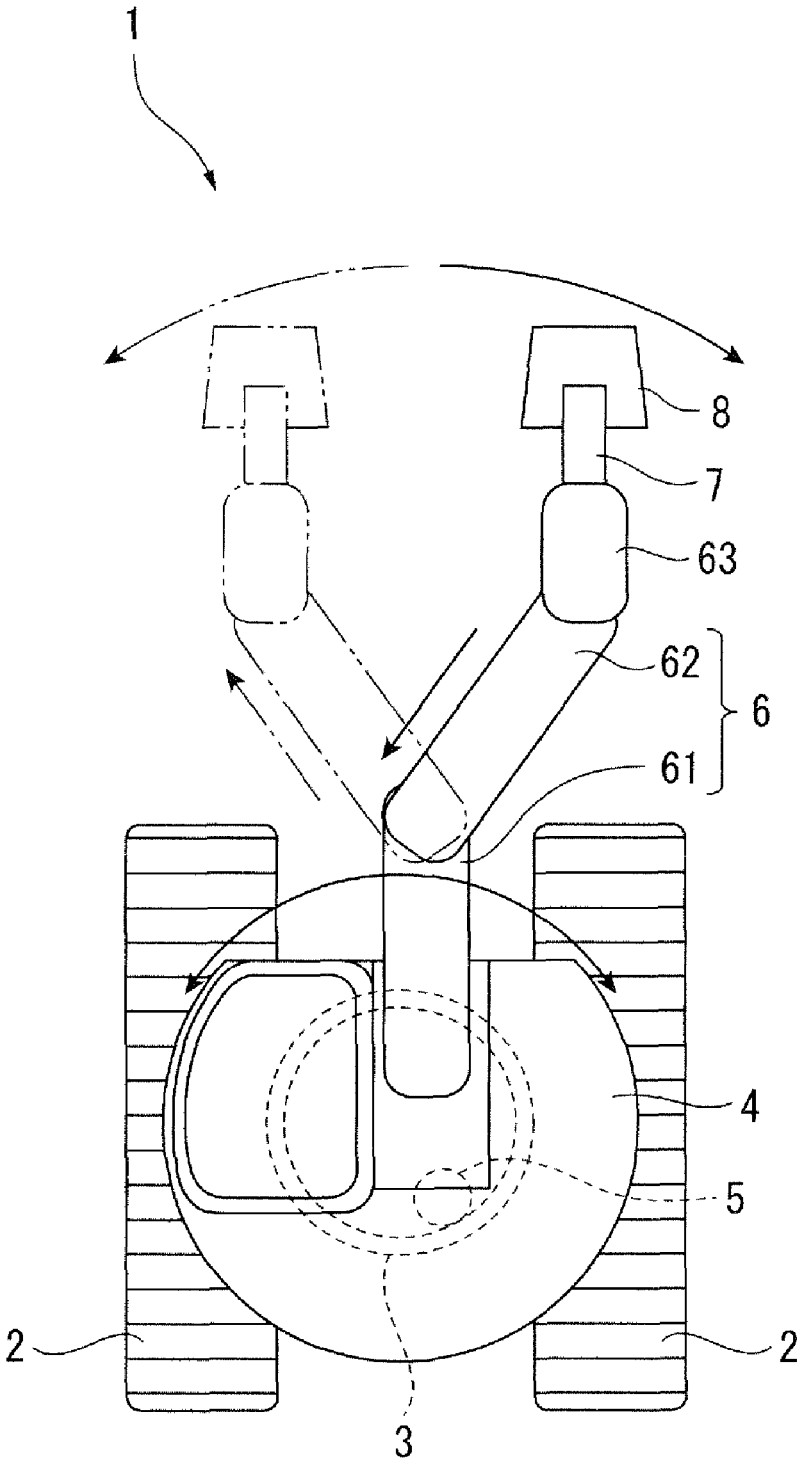
FIG. 2 is a plan view schematically showing a motion of an offset mechanism provided to a rotary body of the construction machine.
Figure 3:
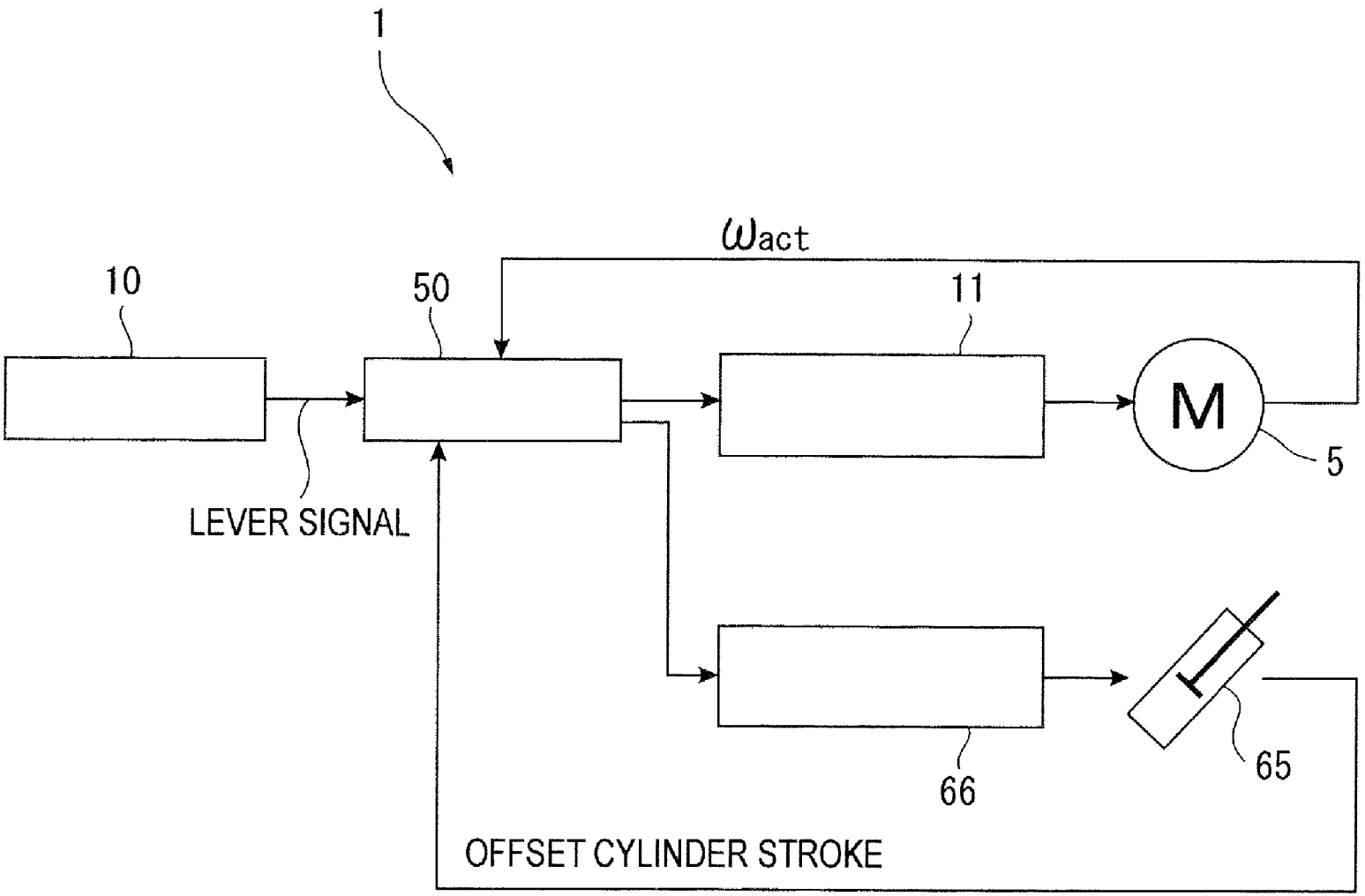
FIG. 3 is a block diagram showing a primary portion of the construction machine.
Figure 4:
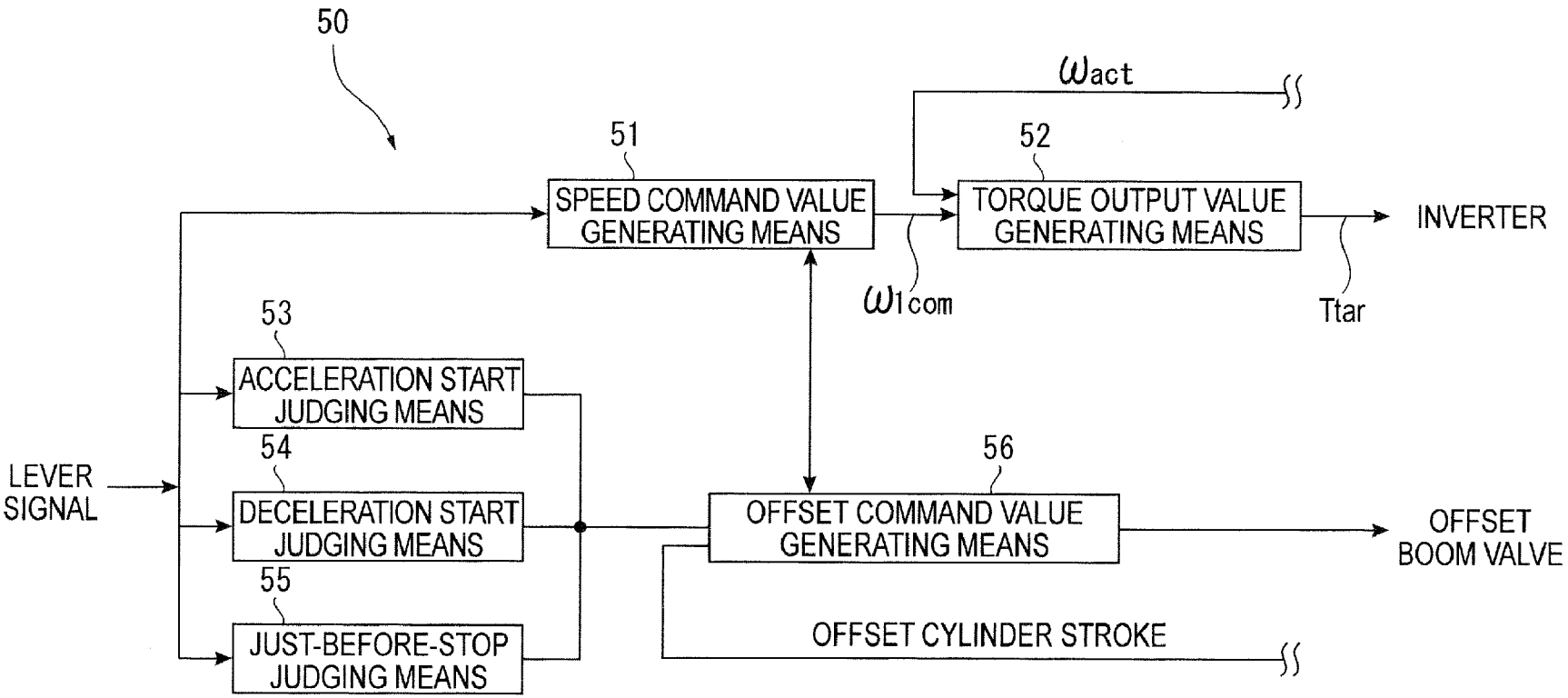
FIG. 4 is a block diagram showing a rotation control device installed in the construction machine.

FIG. 1 is a perspective view showing an overall arrangement of an electric rotary excavator (construction machine) 1 according to a first embodiment of the present invention; FIG. 2 is a plan view schematically showing a motion of an offset boom (offset mechanism) 6 provided to a rotary body 4 of the electric rotary excavator 1; FIG. 3 is a block diagram showing a primary portion of the electric rotary excavator 1; and FIG. 4 is a block diagram showing a rotation control device 50 installed in the electric rotary excavator 1.

In FIGS. 1 and 2, the electric rotary excavator 1 includes the rotary body 4 that is mounted on a track frame of a base carrier 2 via a swing circle 3, the rotary body 4 rotated by an electric motor 5 that is engaged with the swing circle 3. Although not shown, a power source of the electric motor 5 is a generator mounted on the rotary body 4, the generator driven by an engine.

The rotary body 4 is provided with the offset boom 6, an arm 7 and a bucket 8 respectively operated by hydraulic cylinder 6A, 7A and 8A, the components 6, 7 and 8 forming a work machine 9. A hydraulic source of the hydraulic cylinders 6A, 7A and 8A is a hydraulic pump driven by the engine. Accordingly, the electric rotary excavator 1 is a hybrid construction machine having the hydraulically-driven work machine 9 and the electrically-driven rotary body 4.

The offset boom 6 includes a first boom (proximal-end side work member) 61 on a proximal end side that is supported on the rotary body 4 and a second boom (distal-end side work member) 62 that is rotatably coupled to a distal end side of the first boom 61. Provided on a distal end of the second boom 62 is a bracket 63 that rotates in a longitudinal axis direction, and the arm 7 is coupled to the bracket 63. The bracket 63 and the distal end of the first boom 61 are coupled to each other with rods 64 provided on both lateral sides thereof, the distal end portion of the first boom 61, the second boom 62, the bracket 63 and the rods 64 forming a parallel linkage.

In the offset boom 6 described above, a proximal end side of the second boom 62 and the bracket 63 are coupled to each other by a hydraulic offset cylinder 65. By contracting the offset cylinder 65, the second boom 62 is rotated and offset clockwise relative to the first boom 61 as shown by the solid line in FIG. 2, while by extending the offset cylinder 65, the second boom 62 is rotated and offset counterclockwise as shown by the dashed-two dotted line in FIG. 2.

In the electric rotary excavator 1 described above, a rotation lever 10 (typically serving also as a work machine lever for operating the arm 7) outputs a lever signal according to a tilt angle to the rotation control device 50 as shown in FIG. 3. The rotation control device 50 controls a drive of the electric motor 5 based on the lever signal to control the rotation of the rotary body 4.

Specifically, as shown in FIG. 4, the lever signal is first input to a speed command value generating means 51 of the rotation control device 50, where the lever signal is converted to a speed command value ω1com for the electric motor 5. A difference between the speed command value ω1com and a fed-back actual speed (actual rotation speed) of the electric motor 5 ωact is converted by a torque output value generating means 52 to a torque command value Ttar through multiplication by a speed gain. Accordingly, in a case where the actual speed is not increased even when the rotation lever 10 is tilted to a large extent, the rotation control device 50 performs a control such that the torque command value Ttar is increased to be close to the speed command value ω1com. Note that such control is a speed control performed by a typical P (Proportional) control.

The converted torque command value Ttar is output to an inverter 11. The inverter 11 converts the input torque command value Ttar to a current value and a voltage value in order to control the electric motor 5 to drive at the speed command value ω1com.

[2] Arrangement of Rotation Control Device

Now, the arrangement of the rotation control device 50, especially arrangements of components other than the above-described speed command value generating means 51 and torque output value generating means 52, will be described in detail.

In FIG. 4, the rotation control device 50 includes an acceleration start judging means 53, a deceleration start judging means 54, a just-before-stop judging means 55 and an offset command value generating means 56 in addition to the above-described means 51, 52. These means 51 to 56 are provided as software each including an operational expression or the like processed by a computer of the rotation control device 50.

The speed command value generating means 51 generates a target speed ωcom of the rotary body 4 and generates based on the target speed ωcom and later-described judgment results of the means 53 to 55 the speed command value ω1com of the electric motor 5. Here, the target speed ωcom is a value generated based on the lever signal, the target speed ωcom being a reference value of the speed command value ω1com. In other words, the speed command value generating means 51 uses the target value ωcom for the speed command value ω1com except when the speed command value generating means 51 generates a speed command value ω1com based on a command from the later-described offset command value generating means 56.

The acceleration start judging means 53 judges whether a rotation operation is started or a rotation acceleration operation is started. This judgment can be made, for instance, by detecting a leading edge of the lever signal. When the rotary body 4 starts acceleration at the start of rotation and when the rotary body 4 starts acceleration, from a state where the rotary body 4 is rotated at a constant speed with the rotation lever 10 tilted by a predetermined angle, by further tilting the rotation lever 10, the leading edge is observed in the lever signal when the rotation lever 10 is operated. The acceleration start judging means 53 detects this leading edge to judge whether or not the rotary body 4 starts acceleration.

The deceleration start judging means 54 judges whether or not a rotation deceleration operation is started. This judgment can be made by, for instance, detecting a trailing edge of the lever signal. When the rotary body 4 starts the deceleration, from a state where the rotary body 4 is rotated at a constant speed, by pulling up the rotation lever 10 by a predetermined angle and when the rotary body 4 starts deceleration through an operation in which the rotation lever 10 is directly moved back to a neutral position, the trailing edge is observed in the lever signal when the rotation lever 10 is operated, in a manner contrast to the acceleration operation described above. By detecting the trailing signal, the deceleration start judging means 54 judges whether or not the rotary body 4 starts deceleration.

The just-before-stop judging means 55 judges whether or not the rotary body 4 is in just before the stop. When the rotation lever 10 is positioned at the neutral position (i.e., the lever signal is zero) and the electric motor 5 is driven at a predetermined speed (rotation speed) or lower or at the target speed ωcom of a predetermined value or lower, the just-before-stop judging means 55 judges that the rotary body 4 is in just before the stop.

The offset command value generating means 56 generates a command signal according to the judgment results of the means 53 to 55 and outputs the command signal to an offset boom valve 66 that controls the offset cylinder 65 and to the speed command value generating means 51. Specifically, the offset command value generating means 56 issues a command such that the offset boom valve 66 offsets the second boom 62 of the offset boom 6 in a rotation direction or in a reverse rotation direction relative to the first boom 61, while issuing a command such that the speed command value generating means 51 generates a speed command value ω1com with a value different from the target speed ωcom, in accordance with the judgment results of the means 53 to 55.

The offset command value generating means 56 adjusts an offset change amount of the rotary body 4 in just before the stop in accordance with its rotation state (for instance, a deceleration degree in the present embodiment). Specifically, when the rotary body 4 is stopped from a high-speed rotation state, the deceleration degree is large, so that the offset command value generating means 56 generates a relatively large offset change amount in the reverse rotation direction at the time of just before the stop. On the other hand, when the rotary body 4 is stopped from a low-speed rotation state, the deceleration degree is relatively small, so that the offset command value generating means 56 generates a relatively small offset change amount in the reverse rotation direction at the time of just before the stop.

Figure 5:
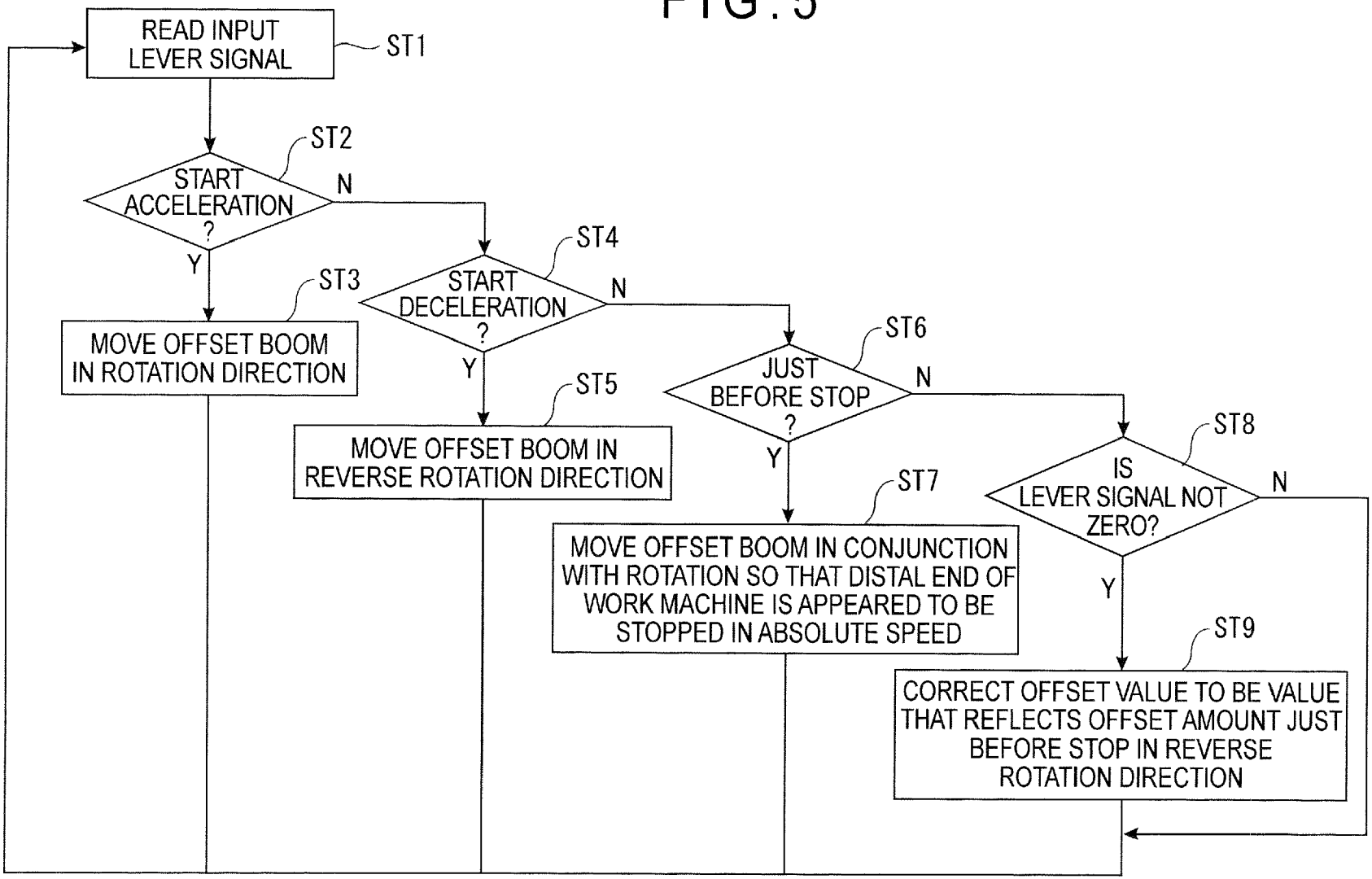
FIG. 5 is a flowchart explaining a rotation control method.

[3] Flow for Judging Rotation State and Process After Judgment in Rotation Control Device Next, referring to FIG. 5, a flow for judging the rotation state by the means 53 to 55 and a process of the offset command value generating means 56 after the judgments will be described.

First, the rotation control device 50 reads an input value of the lever signal (ST1).

The acceleration start judging means 53 monitors the lever signal from the rotation lever 10 to detect the leading edge of the lever signal (ST2). When the leading edge is detected, the offset command value generating means 56 issues a command to offset the second boom 62 in the rotation direction (ST3).

On the other hand, when a rotation deceleration operation is started by pulling the rotation lever 10 back to some extent from a rotation state at a constant speed or back to the neutral position, the leading edge of the lever signal is not detected. Instead, the deceleration start judging means 54 detects the trailing edge of the lever signal (ST4). When the trailing edge is detected, the offset command value generating means 56 issues a command such that the second boom 62 is offset in the reverse rotation direction (ST5).

When the rotation speed or the target speed ωcom of the electric motor 5 becomes lower than a predetermined value and the lever signal is zero, the just-before-stop judging means 55 judges that the rotary body 4 is in just before the stop (ST6). At this time, the offset command value generating means 56 issues a command to move the second boom 62 in conjunction with the rotation so that an absolute speed of the bucket 8 on a distal end of the work machine 9 is appeared to be zero (ST7).

When judgment results of the means 53 to 55 are all "N" in all of the steps ST2, ST4 and ST6 and the rotation control device 50 judges that the lever signal is not zero (i.e., the rotation lever 10 is not at the neutral position) (ST8), the offset command value generating means 56 issues a command to offset the second boom 62 in the rotation direction so that the offset amount is corrected in advance to be equal to the offset change amount in the reverse rotation direction at the time of just before the stop (ST9).

[4] Rotation Control Method by Rotation Control Device

Next, referring to FIGS. 6 and 7A to 7G, the rotation control method of the rotary body 4 will be described in detail.

Figure 6:
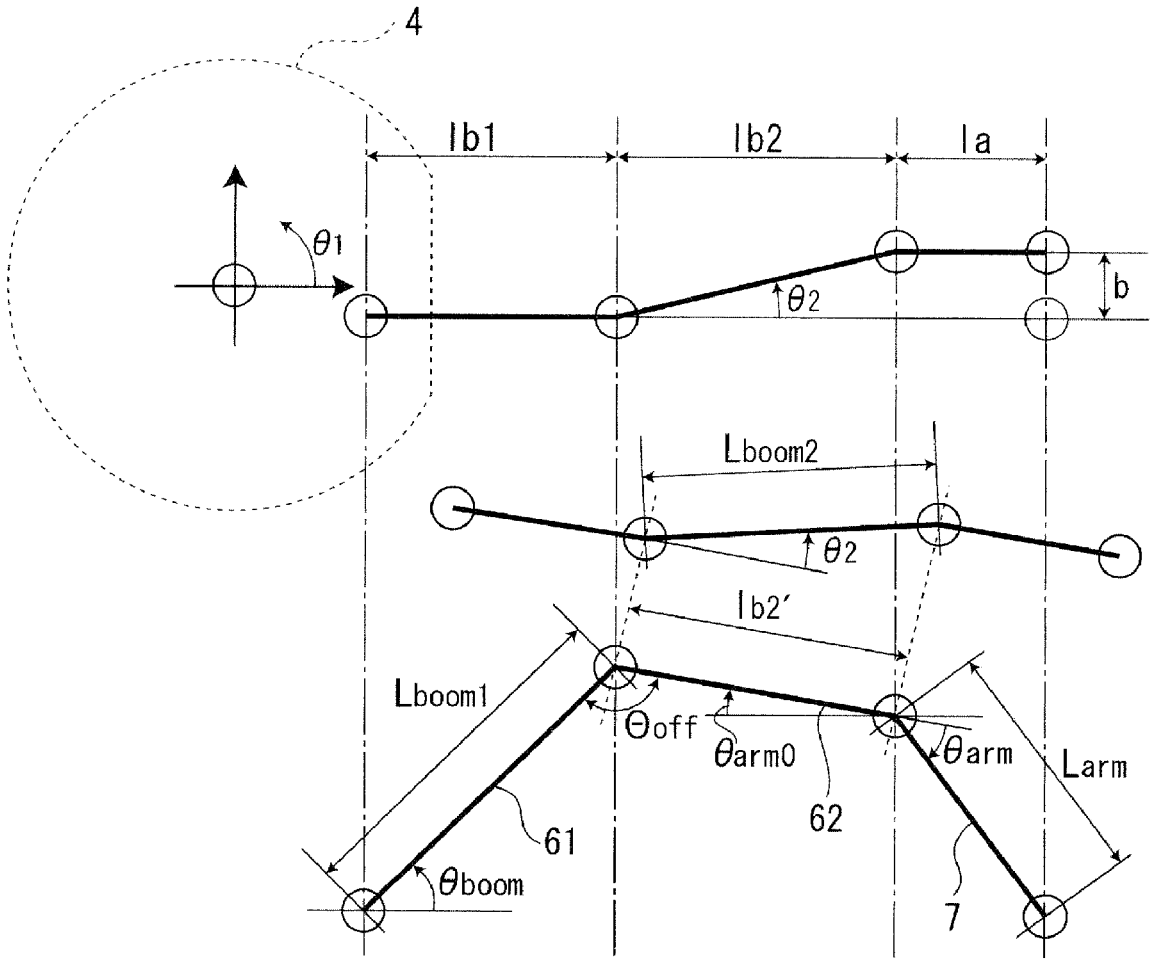
FIG. 6 is a schematic illustration explaining a geometric relation between an offset boom and an arm.

First, an explanation will be given about a geometric relation between the first boom 61, the second boom 62 and the arm 7, which is necessary for explaining the rotation control method. FIG. 6 is a schematic illustration of the work machine 9 and shows, in descending order from the top of the figure, the work machine 9 seen from the upper side thereof, seen from an upper side in a vertical direction relative to a swinging surface of the second boom 62 and seen from a lateral side.

In FIG. 6, the reference symbols 1*b*1, 1*b*2 and 1*a* respectively show projected lengths of the first boom 61, the second boom 62 and the arm 7 in a state where the electric rotary excavator 1 is seen from the upper side in the vertical direction, which are obtained from geometric relations of a length Lboom1 of the first boom 61, a length Lboom2 of the second boom 62, a length Larm of the arm 7, a vertical direction angle (−)off and a horizontal direction angle θ2 between the booms 61 and 62, θarm0, θarm and 1*b*2'. Note that the vertical direction angle Θoff is a fixed value and the horizontal direction angle θ2 is a variable value that can be obtained from a measurement value of a potentiometer or an offset cylinder stroke. θ1 shows a rotation angle of the rotary body 4.

Here, a displacement amount of the bucket 8 (i.e., a displacement amount b of the distal end of the arm 7), of the time when the offset cylinder 65 is not operated and only the electric motor 5 is driven can be obtained by Equation (1) below.

$$B=(1b1+1b2+1a)\times\sin(\theta 1) \quad (1)$$

On the other hand, a displacement amount b' of the distal end of the arm 7 of the time when the electric motor 5 is not operated and only the offset cylinder 65 is driven can be obtained by Approximation (2) below.

$$b'=1b2\times\sin(\theta 2) \quad (2)$$

Accordingly, a speed v of the distal end of the arm 7 of the time when only the electric motor 5 is driven can be obtained by Equation (3) below, while a speed v' of the distal end of the arm 7 of the time when only the offset cylinder 65 can be obtained by Equation (4) below, where an angular speed of the electric motor 5 is expressed as ω1 and an angular speed of the second boom 62 relative to the first boom 61 in θ2 direction is expressed as ω2.

$$v=(1b1+1b2+1a)\times\omega 1 \quad (3)$$

$$v'=1b2\times\omega 2 \quad (4)$$

Accordingly, by issuing a command that satisfies the relation of v=v', the speed of the bucket 8 of the time when only the electric motor 5 is driven and that of the time when only the offset cylinder 65 is driven can be equal to each other. In the rotation control performed by the rotation control device 50, this relation is used especially in the control at just before the stop of the rotary body 4.

Next, referring to FIGS. 7A to 7G, the rotation control method of the rotary body 4 will be described by taking as a concrete example a process from a point when the operator requests to start the rotation to a point when the rotary body 4 is stopped.

Figure 7A:
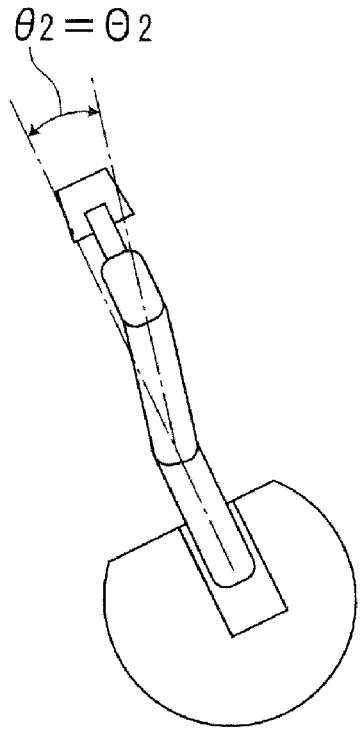
FIG. 7A is a first schematic illustration explaining the rotation control method.

In FIG. 7A, the rotary body 4 is stopped in a state where the second boom 62 is positioned with the horizontal direction angle $\theta 2$ being $\Theta 2$ relative to the first boom 61. In this state, when the operator tilts the rotation lever 10 to request to start the rotation, which is assumed to be a clockwise rotation in the present embodiment, of the rotary body 4 in a stopped state or to accelerate the rotary body 4, the speed command value generating means 51 generates the target speed $\omega$com of the rotary body 4 based on the lever signal.

Figure 7B:
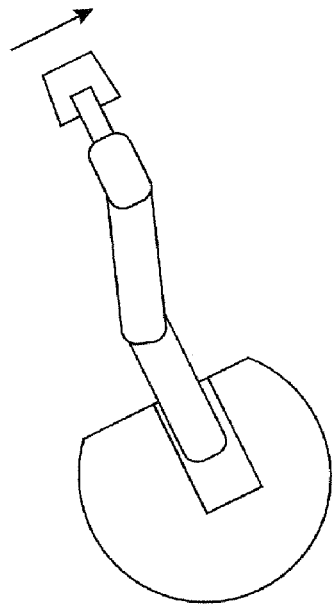
FIG. 7B is a second schematic illustration explaining the rotation control method.

When acceleration start judging means 53 judges that the rotation operation is started or the rotation acceleration operation is started, as shown in FIG. 7B, the offset command value generating means 56 issues a command to first offset only the second boom 62 of the offset boom 6 in a rotation direction requested by the operator. Specifically, the offset command value generating means 56 issues a command such that the offset boom valve 66 rotates the second boom 62 and that the speed command value generating means 51 keeps the speed command value $\omega 1$com of the electric motor 5 to be zero without using the value of the target speed $\omega$com. At this time, a speed command value $\omega 2$com as a target angular speed of the offset of the second boom 62 can be obtained by Equation (5) below.

$$\omega 2\text{com}=(1b1+1b2+1a)/1b2\times\omega\text{com} \quad (5)$$

Figure 7C:
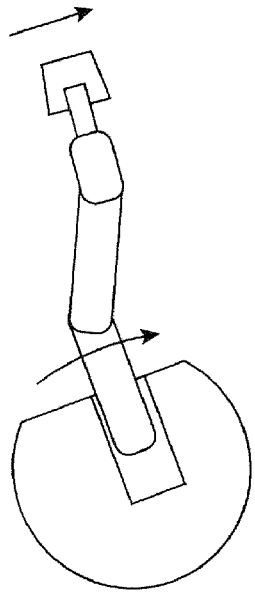
FIG. 7C is a third schematic illustration explaining the rotation control method.

When the speed command value $\omega 2$com becomes larger than a predetermined value $\Omega$A due to the increase of the target speed $\omega$com, the offset command value generating means 56 issues a command to start the rotation of the rotary body 4 while offsetting the second boom 62 in the rotation direction as shown in FIG. 7C. Specifically, the offset command value generating means 56 issues a command such that the speed command value generating means 51 gradually increases the target command value $\omega 1$com so as to be close to the target speed $\omega$com. The speed command value generating means 51 increases the target command value $\omega 1$com by a predetermined value $\Omega 1$ until the target command value $\omega 1$com reaches the target speed $\omega$com. At this time, the offset command value generating means 56 issues a command such that the offset boom valve 66 reduces the target command value $\omega 2$com by a predetermined value $\Omega$A2 until the target command value $\omega 2$com becomes zero.

By performing such a process when the rotation operation or the rotation acceleration operation is started, the second boom 62 is first offset and, due to its reaction force, a clearance on the rotation direction side is contracted, where the actual rotation of the rotary body 4 is started.

Figure 7D:
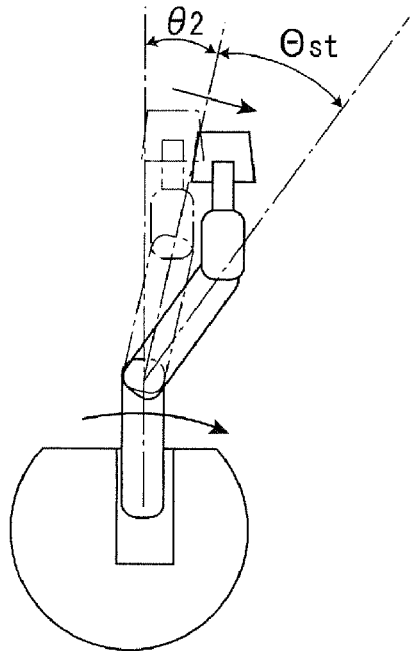
FIG. 7D is a fourth schematic illustration explaining the rotation control method.

Next, when a tilt amount of the rotation lever 10 tilted by the operator is constant, the rotary body 4 is accelerated toward the target speed $\omega$com and then rotated in a constant speed rotation state. In this case, by issuing a command such that the offset boom valve 66 offsets the second boom 62 in the rotation direction as shown in FIG. 7D or in the reverse rotation direction, the offset command value generating means 56 corrects the offset amount in advance such that a change amount from an offset amount (initial value) before the start of the rotation becomes equal to an offset change amount in the rotation reverse direction in just before the stop of the rotation.

Specifically, the offset command value generating means 56 offsets the second boom 62 by a predetermined value $-\Omega 2$ in the reverse rotation direction in a state where a condition $\theta 2>\Theta 2+\Theta st+\Delta\Theta$ is satisfied. Then, when a condition $\theta 2<\Theta 2+\Theta st+\Delta\Theta$ is satisfied, the offset command value generating means 56 issues a command to set the speed command value $\omega 2$com to zero. On the other hand, the offset command value generating means 56 offsets the second boom 62 by a predetermined value $\Omega 2$ in the rotation direction in a state where a condition $\theta 2<\Theta 2+\Theta st-\Delta\Theta$ is satisfied. Then, when a condition $\theta 2>\Theta 2+\Theta st-\Delta\Theta$ is satisfied, the offset command value generating means 56 issues a command to set the speed command value $\omega 2$com to zero. Here, $\Theta 2$, $\Theta st$ and $\Delta\Theta$ each represent an angle of the second boom 62 relative to the first boom 61, where $\Theta st$ represents an angle before starting the rotation operation or before starting the rotation acceleration operation and $\Delta\Theta$ represents a predetermined value.

$\Theta st$ is also a predetermined value that is obtained by reflecting an estimated offset change amount in the reverse rotation direction in just before the stop, which is a value substantially equal to the offset change amount in the reverse rotation at this time. This means that, for the offset of the second boom 62 in the reverse rotation direction in just before the stop, the second boom 62 has been offset in the rotation direction by an amount obtained by reflecting the estimated offset change amount in the reverse rotation direction, which means that a correction is performed such that the second boom 62 returns to the offset amount before the start of the rotation after the rotation is completed.

It should be noted that, when the rotation lever 10 is further tilted down by the operator from the constant rotation state, the acceleration start judging means 53 detects the leading edge of the lever signal output in conjunction with the rotation acceleration operation, where the clearance generated during the rotation at the constant speed is contracted and then the rotary body 4 is actually accelerated, similarly to the process in starting the rotation operation or the rotation acceleration operation.

Figure 7E:
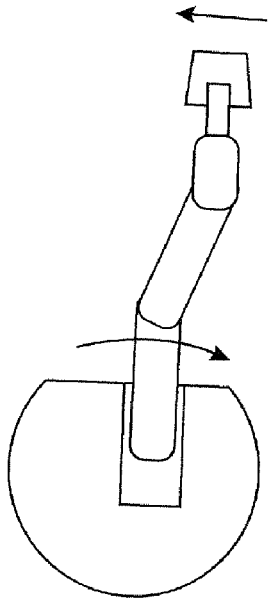
FIG. 7E is a fifth schematic illustration explaining the rotation control method.

Thereafter, when the deceleration start judging means 54 judges that the rotation deceleration operation is started, the offset command value generating means 56 issues a command to first offset the second boom 62 in a direction reverse to the rotation direction of the rotary body 4 as shown in FIG. 7E, namely issues a command such that the offset boom valve 66 offsets the second boom 62 in the reverse rotation direction in a manner changing the speed command value $\omega 2$com by a predetermined value $-\Omega 3$ for a predetermined time period. Note that the offset change amount at this time may be an amount substantially equal to the offset change amount in the rotation direction of the time when the rotation acceleration operation is started.

By performing such process when the rotation deceleration operation is started, the second boom 62 is first offset and a clearance on the reverse rotation side is contracted due to the reaction force generated in the offset before the rotary body 4 actually starts deceleration.

Figure 7F:
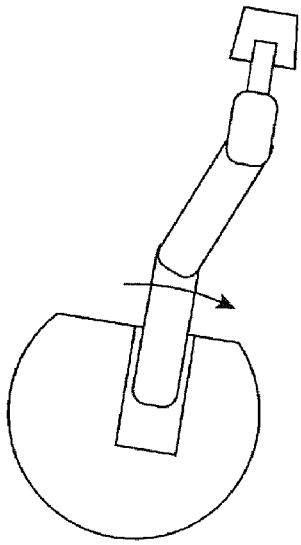
FIG. 7F is a sixth schematic illustration explaining the rotation control method.

After the predetermined time period elapses, the speed command value generating means 51 decelerates the rotary body 4 using the target speed $\omega$com for the speed command value $\omega 1$com as usual as shown in FIG. 7F.

Figure 7G:
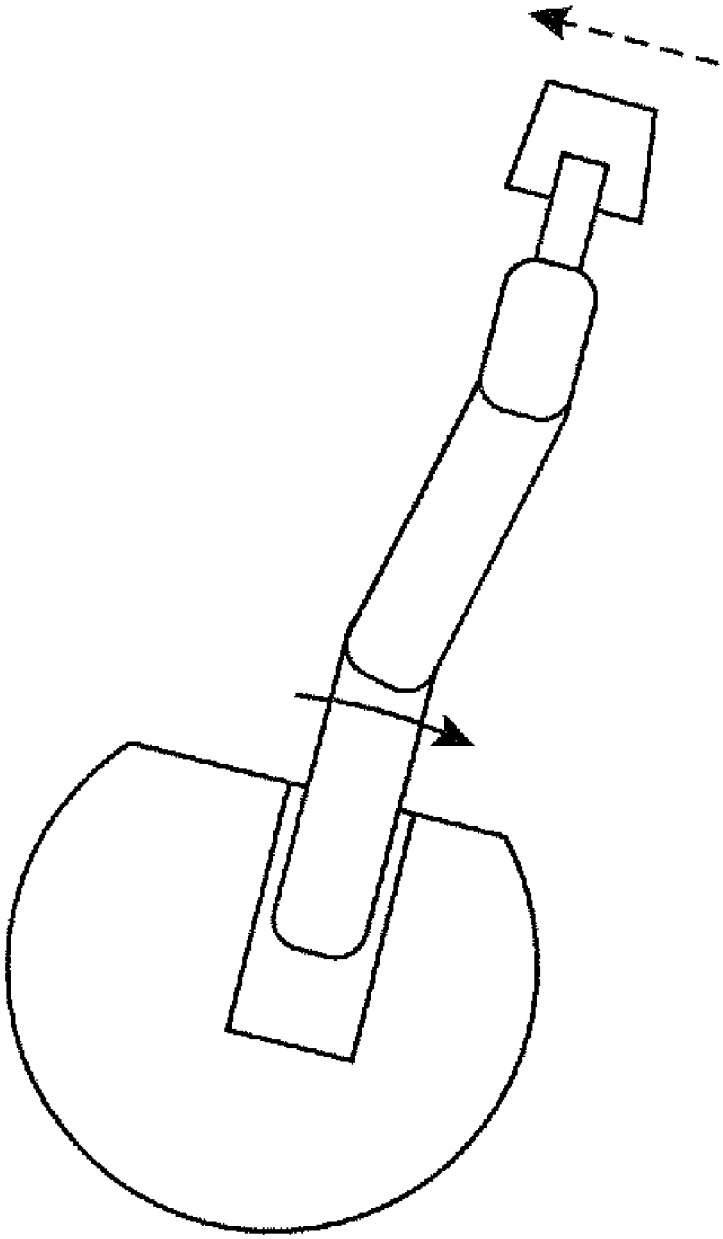
FIG. 7G is a seventh schematic illustration explaining the rotation control method.

When the just-before-stop judging means 55 judges that the rotary body 4 is in just before the stop, the offset command value generating means 56 issues a command such that the offset boom valve 66 further offsets the second boom 62 in the reverse rotation direction as shown in FIG. 7G. Specifically, when the speed command value $\omega 1$com becomes smaller than a predetermined value $\Omega$B, the offset command value generating means 56 decreases the speed command value $\omega 2$com by the predetermined value $\Omega 2$ until the speed command value $\omega 2$com reaches a value obtained by Equation (6) below.

$$\omega 2com=(1b1+1b2+1a)/1b2\times\omega 1com \quad (6)$$

The offset change amount at this time is conceived to be larger than the offset change amount in starting the rotation deceleration operation, although it depends on a deceleration degree in just before the stop.

Thereafter, the offset command value generating means 56 issues a command such that the offset boom valve 66 rotates the second boom 62 at the speed command value ω2com obtained by Equation (6) above. At this time, the rotation speed of the second boom 62 is a speed that is in conjunction with the rotation of the rotary body 4 so that the absolute speed of the bucket 8 on the distal end of the work machine 9 is appeared to be zero. By performing such a process in just before the stop of the rotary body 4, the rotary body 4 is stopped smoothly in a manner slightly flowing in the rotation direction from a state in which the bucket 8 is substantially stopped.

It should be noted that when the offset change amount in the rotation direction during rotation and the offset change amount in the reverse rotation direction in just before the stop are different, the second boom 62 might not properly return to the initial value. Therefore, it is necessary to correct in advance (during the rotation) the change amount from the offset amount before the start of the rotation so as to be equal to the offset change amount in just before the stop or to offset the second boom 62 in a proper direction just after the stop so as to cancel a displacement amount. Although both of the methods are available, it is preferable to perform the correction during the rotation when removing the sense of discomfort of the operator is regarded as important.

[5] Advantages of Embodiment

According to the present embodiment, the following advantages can be attained.

(1) Since the second boom 62 is offset in the rotation direction when the rotation lever 10 is operated by the operator to start the rotation operation or the rotation acceleration operation, due to the reaction force at this time, clearances between the components of the work machine 9 and a clearance (backlash) between the swing circle 3 and a gear on the electric motor 5 side can be contracted in the rotation direction. With the arrangement, since the rotary body 4 starts actual rotation or acceleration after the offset of the second boom 62 in the rotation direction, the rotation operation can be performed without generation of an impact in starting the rotation or the rotation acceleration, thereby enhancing the operability.

(2) Since the second boom 62 is offset in the reverse rotation direction when the rotation lever 10 is pulled back to start the rotation deceleration operation, due to the reaction force at this time, the clearances between the components can be contracted toward a side where the impact is not generated by the deceleration just before the rotary body 4 starts the deceleration. Accordingly, since the rotary body starts the actual deceleration after the offset of the second boom 62 in the reverse rotation direction, the rotary body is decelerated with the clearances being contracted, so that the rotation deceleration operation can be performed without generation of the impact, thereby enhancing the operability.

(3) The second boom 62 is offset in the reverse rotation direction just before the stop of the rotation. At this time, by offsetting the second boom 62 at a speed in conjunction with the rotation such that an apparent absolute speed of the second boom 62 (bucket 8) is appeared to be zero at a targeted stop position, the rotary body 4 can be stopped smoothly in a manner slightly flowing in the rotation direction after the second boom 62 is stopped. In addition, a braking distance becomes long due to the flowing motion to prevent a sudden stop, thereby stopping the rotary body 4 smoothly. Therefore, a swinging-back or the like of the rotary body 4 can be prevented, thereby enhancing a stop position accuracy of the bucket 8.

(4) In the offset just before the stop, the offset command value generating means 56 can adjust the offset amount in accordance with the rotation state of the rotary body 4. With the arrangement, when the rotary body 4 is stopped from the high-speed rotation state, the offset amount is set to large, which increases an amount of the flowing motion of the rotary body 4 and also increases the braking distance, so that the sudden stop can be securely prevented, thereby stopping the rotary body 4 smoothly.

(5) The offset in the reverse rotation direction just before the stop is corrected and canceled by the offset in the rotation direction during the rotation. With the arrangement, when the rotary body 4 is stopped, the second boom 62 can return to the offset amount before the rotation, so that the operator can perform the rotation operation without feeling the sense of discomfort.

(6) When there is a difference between the offset change amount in the reverse rotation direction just before the stop and the offset change amount in the rotation direction during the following rotation, the offset command value generating means 56 issues a command to remove the difference, so that the offset amount of the second boom can securely return to the initial value before the rotation.

(7) The offset boom 6 itself is likely affected by the clearance and receives the impact because it has a coupling portion between the first boom 61 and the second boom 62. In this regard, by applying the present invention to the electric rotary excavator 1 equipped with the offset boom 6, the impact generated due to the clearance at the coupling portion can also be suppressed, so that there is a great advantage in applying the present invention.

(8) When the rotary body 4 is driven by the electric motor 5, the motion of the rotary body 4 typically becomes subtle and is likely affected by the clearance. In this regard, by applying the present invention to the electric rotary excavator 1 having such an arrangement, the influence of the clearance can be reduced, where the advantage of the present invention is noticeable.

It should be noted that the present invention is not limited to the embodiments described above, but includes other components or the like that can achieve the object of the present invention, and also include modifications as shown below.

Figure 8:
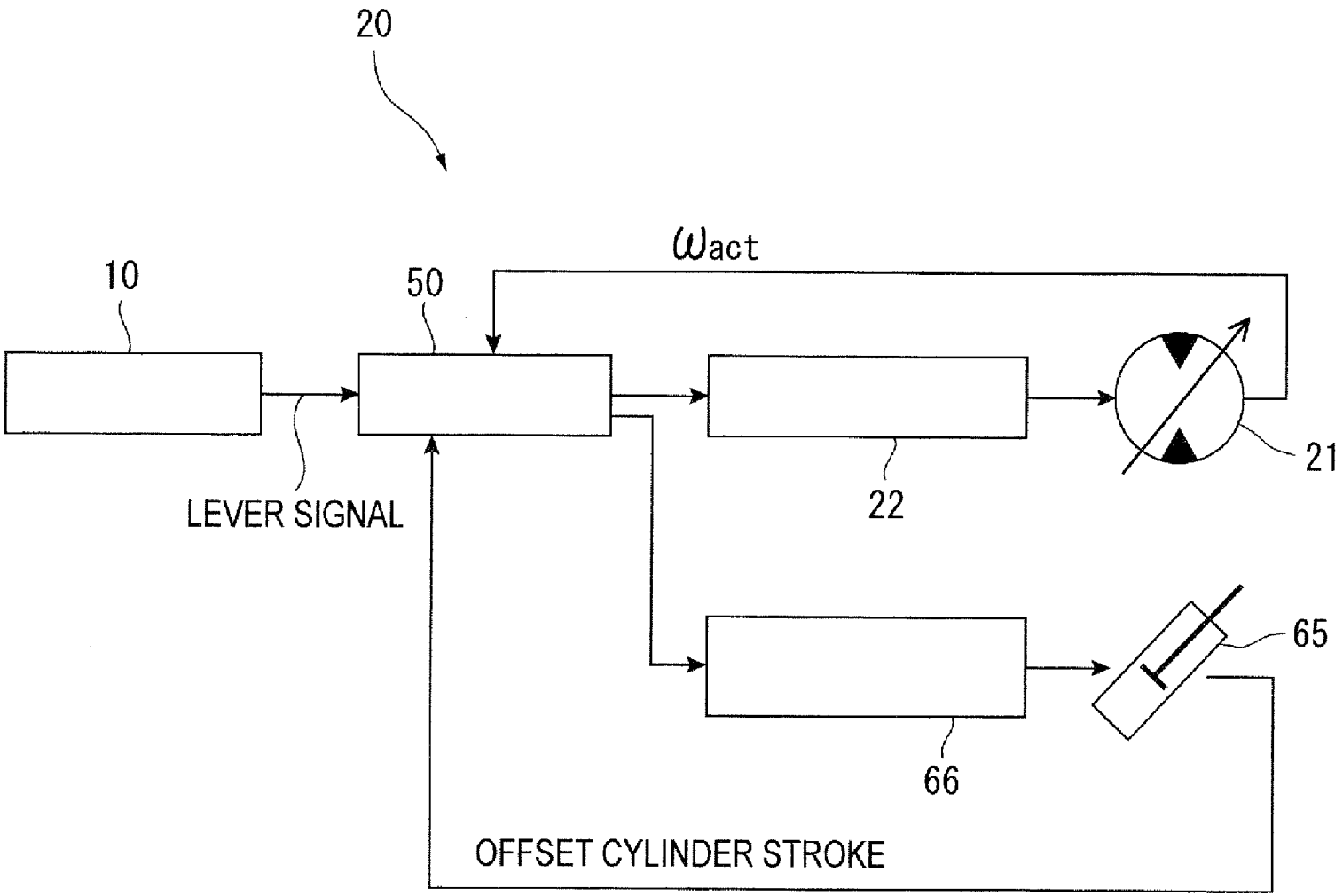
FIG. 8 is a block diagram showing a modification of the present invention.

For example, although the rotary body 4 is rotated by the electric motor 5 in the electric rotary excavator 1 of the embodiment above, the rotary body 4 may be rotated by a hydraulic motor 21 as in a hydraulic excavator (construction machine) 20 shown in FIG. 8. In such case, the rotation control device 50 outputs a control signal to an operation valve 22 or the like that controls the hydraulic motor 21.

Figure 9:
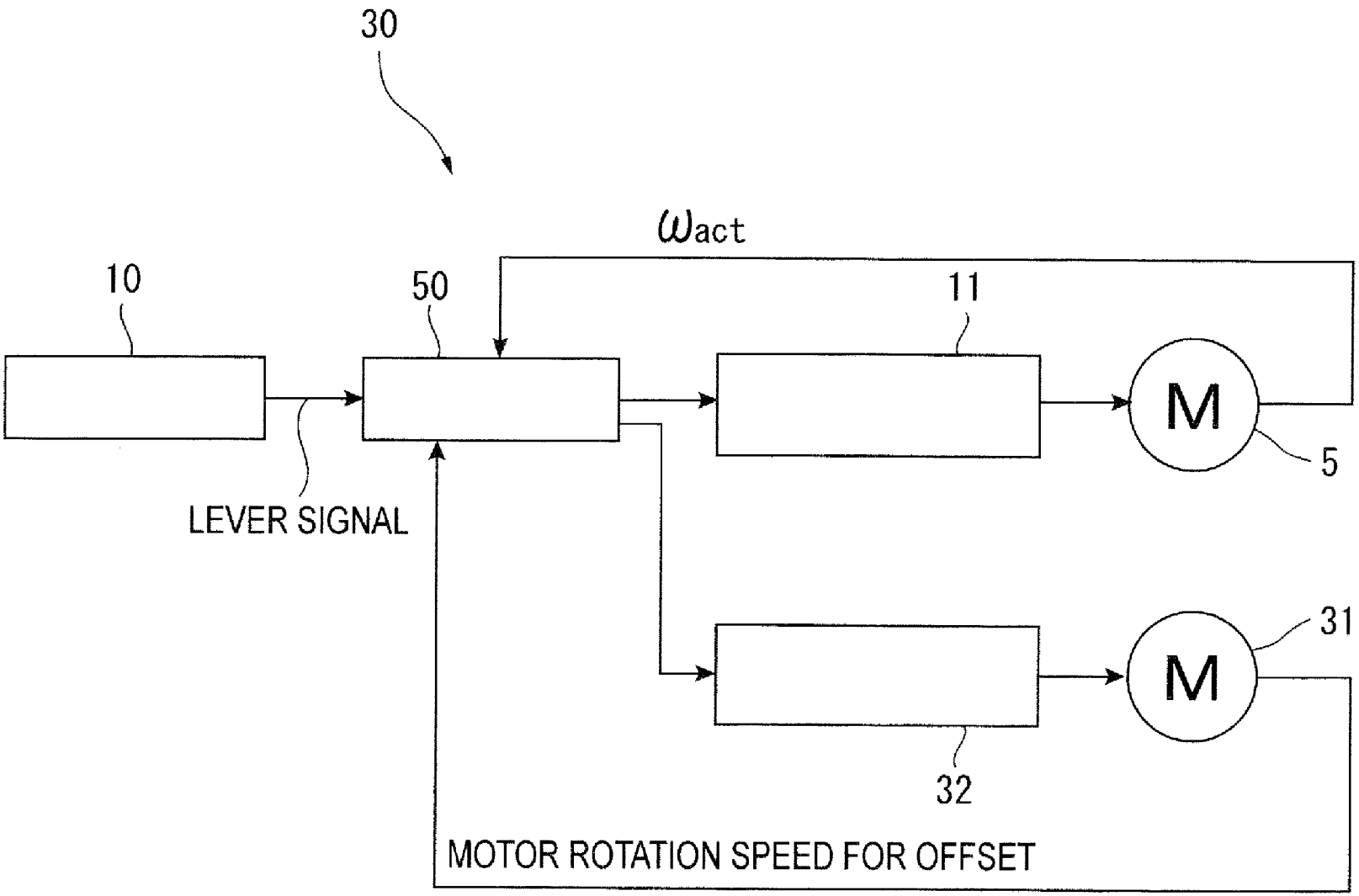
FIG. 9 is a block diagram showing another modification of the present invention.

Although the offset of the second boom 62 is performed by a telescopic motion of the hydraulic offset cylinder 65 in the electric rotary excavator 1 of the embodiment above, the offset of the second boom 62 may be performed by an electric offset motor 31 as in an electric rotary excavator (construction machine) 30 shown in FIG. 9. In such case, a command value corresponding to the offset command value is output to an inverter 32 for the offset motor 31.

Although the offset mechanism of the present invention is exemplified by the offset boom 6 including the first and second booms 61, 62 in the embodiment above, the offset mechanism may have an arrangement in which, for instance, a boom is supported on the rotary body in a manner rotatable in a right-and-left direction (horizontal direction). In such case, the boom that corresponds to the distal-end side work member of the present invention is offset in accordance with the rotation state of the rotary body.

It should be noted that, while the present invention has been described with reference to the specific embodiment and the drawings thereof, various modifications may be made to the described embodiment by those of ordinary skill in the art without departing from the spirit and a scope of the object of the invention.

INDUSTRIAL APPLICABILITY

The present invention is applicable to various types of construction machines having offset mechanisms.

The invention claimed is:

1. A rotation control device that controls a rotary body that is equipped with an offset mechanism including a distal-end side work member, the rotation control device comprising:

at least one of:

an acceleration start judging unit that judges whether a rotation operation is started or a rotation acceleration operation is started;

a deceleration start judging unit that judges whether or not a rotation deceleration operation is started; and a just-before-stop judging unit that judges whether or not the rotation of the rotary body is just before being stopped, and an offset command value generating unit that generates a command signal in accordance with a result of a judgment by the at least one of the acceleration start judging unit, the deceleration start judging unit and the just-before-stop judging unit, so that the offset mechanism is moved in conjunction with the rotation operation of the rotary body.

2. The rotation control device according to claim 1, wherein the offset command value generating unit offsets the distal-end side work member in a rotation direction in conjunction with the rotation operation when the acceleration start judging unit judges that the rotation operation or an acceleration operation is started.

3. The rotation control device according to claim 1, wherein the offset command value generating unit offsets the distal-end side work member in a reverse rotation direction in conjunction with the rotation operation when the deceleration start judging unit judges that a rotation deceleration operation is started.

4. The rotation control device according to claim 1, wherein the offset command value generating unit offsets the distal-end side work member in a reverse rotation direction in conjunction with the rotation operation when the just-before stop judging unit judges that the rotation of the rotary body is just before being stopped.

5. The rotation control device according to claim 4, wherein an offset change amount of the offset command value generating unit is adjustable in accordance with a rotation state of the rotary body.

6. The rotation control device according to claim 1, wherein the offset command value generating unit generates a command for correcting a generated offset toward an initial value.

7. A rotation control method for controlling a rotary body that is equipped with an offset mechanism including a distal-end side work member, the method comprising:

at least one of:

judging whether a rotation operation is started or a rotation acceleration operation is started;

judging whether or not a rotation deceleration operation is started; and judging whether or not a rotation of the rotary body is just before being stopped, and generating a command signal in accordance with a result of a judgment provided by at least one of said judgings, so that the offset mechanism is moved in conjunction with the rotation operation of the rotary body.

8. A construction machine, comprising:

a rotary body that is equipped with an offset mechanism including a distal-end side work member; and a rotation control device that controls the rotary body, the rotation control device comprising:

at least one of:

an acceleration start judging unit that judges whether a rotation operation is started or a rotation acceleration operation is started;

a deceleration start judging unit that judges whether or not a rotation deceleration operation is started; and a just-before-stop judging unit that judges whether or not the rotation of the rotary body is just before being stopped, and an offset command value generating unit that generates a command signal in accordance with a result of the judgment by at least one of the judging units, so that the offset mechanism is moved in conjunction with the rotation operation of the rotary body.

9. The construction machine according to claim 8, wherein:

the offset mechanism includes a proximal-end side work member supported on the rotary body and a distal-end side work member that is coupled to the proximal-end side work member, the distal-end side work member being offset, and the rotary body is rotated by an electric motor.

10. The rotation control device according to claim 2, wherein the offset command value generating unit generates a command for correcting a generated offset toward an initial value.

11. The rotation control device according to claim 3, wherein the offset command value generating unit generates a command for correcting a generated offset toward an initial value.

12. The rotation control device according to claim 4, wherein the offset command value generating unit generates a command for correcting a generated offset toward an initial value.

13. The rotation control device according to claim 5, wherein the offset command value generating unit generates a command for correcting a generated offset toward an initial value.

14. The rotation control device according to claim 1, wherein the rotation control device comprises all of the acceleration start judging unit, the deceleration start judging unit and the just-before-stop judging unit.

15. The rotation control method according to claim 7, wherein the method comprises all of judging whether a rotation operation is started or a rotation acceleration operation is started, judging whether or not a rotation deceleration operation is started, and judging whether or not a rotation of the rotary body is just before being stopped.

16. The construction machine according to claim 8, wherein the rotation control device comprises all of the acceleration start judging unit, the deceleration start judging unit and the just-before-stop judging unit.

* * * * *